US012179981B2

(12) United States Patent
Baca Sánchez

(10) Patent No.: US 12,179,981 B2
(45) Date of Patent: Dec. 31, 2024

(54) STRUCTURAL SYSTEM FOR LOAD STABILIZATION FRAME AND METHOD FOR ASSEMBLING THE SAME

(71) Applicant: Plásticos Técnicos Mexicanos, S.A. de C.V., Querétaro (MX)

(72) Inventor: Juan Pedro Baca Sánchez, Querétaro (MX)

(73) Assignee: Plasticos Tecnicos Mexicanos, S.A. de C.V., Queretaro (MX)

( * ) Notice: Subject to any disclaimer, the term of this patent is extended or adjusted under 35 U.S.C. 154(b) by 61 days.

(21) Appl. No.: 17/940,116

(22) Filed: Sep. 8, 2022

(65) Prior Publication Data

US 2024/0083650 A1 Mar. 14, 2024

(51) Int. Cl.
*B65D 71/00* (2006.01)
*B65D 19/38* (2006.01)

(52) U.S. Cl.
CPC ..... *B65D 71/0096* (2013.01); *B65D 19/385* (2013.01); *B65D 2519/00139* (2013.01); *B65D 2519/00437* (2013.01); *B65D 2519/00572* (2013.01); *B65D 2571/00043* (2013.01); *B65D 2571/00067* (2013.01)

(58) Field of Classification Search
CPC ..... B65D 71/0096; B65D 19/385; B65D 2519/00139; B65D 2519/00437; B65D 2519/00572; B65D 2571/00043; B65D 2571/00067
USPC ..... 108/53.1, 55.1, 56.1, 57.25
See application file for complete search history.

(56) References Cited

U.S. PATENT DOCUMENTS

| | | | |
|---|---|---|---|
| D168,325 | S | 12/1952 | Abrams |
| 3,178,778 | A | 4/1965 | Reahard |
| 3,318,061 | A | 5/1967 | Stentz |
| 3,389,824 | A | 6/1968 | Berchtold |
| 3,508,679 | A | 4/1970 | Semple |
| 3,552,328 | A | 1/1971 | Sullivan |

(Continued)

FOREIGN PATENT DOCUMENTS

| | | |
|---|---|---|
| CN | 203698869 | 7/2014 |
| EP | 0647513 A2 | 4/1995 |

(Continued)

*Primary Examiner* — Jose V Chen
(74) *Attorney, Agent, or Firm* — Harness, Dickey & Pierce, PLC

(57) ABSTRACT

The present disclosure relates to a top frame-type structural system for load fixing. The system can be used together with pallets that can support a product/merchandise or goods, which are supported, stowed and/or palletized, and subsequently fastened/fixed by a rope, tape and/or strap. In particular, the top frame of the present system is configured to mechanically interact with the strap and efficiently distribute the generated stresses derived from the force tension to which it is subjected to ensure the integrity and bracing of the product. The present system includes a set of structural components, manufactured in a modular manner, which can be assembled and disassembled/taken to pieces, which offers a practical product, easy to handle and transport, and specifically, being manufactured in a modular manner, such that the present structural system can be advantageously transported, packaged using less space, thus improving its logistics and handling.

23 Claims, 16 Drawing Sheets

1

(56) References Cited

U.S. PATENT DOCUMENTS 3,648,883 A 3/1972 Bridenstine
3,684,632 A * 8/1972 Pedraza ..... B32B 5/26 156/92
3,750,596 A 8/1973 Box
3,750,598 A 8/1973 Campbell et al.
3,902,692 A * 9/1975 Skinner ..... B65D 19/0095 248/346.02
3,917,066 A 11/1975 Cloyd
4,700,959 A 10/1987 Lars
4,887,537 A 12/1989 Kellogg
5,180,134 A 1/1993 Mallak
5,197,396 A 3/1993 Breezer et al.
5,351,628 A * 10/1994 Breezer ..... B65D 19/0022 108/57.17
5,388,533 A * 2/1995 Pigott ..... B65D 19/0012 108/56.1
5,473,995 A * 12/1995 Gottlieb ..... B65D 19/38 108/55.1
5,665,285 A 9/1997 Hattori et al.
5,794,543 A * 8/1998 John ..... B65D 19/0022 108/56.1
D417,327 S 11/1999 Craig
6,093,358 A 7/2000 Schiewe et al.
6,096,793 A 8/2000 Lee et al.
6,138,582 A 10/2000 Fujii et al.
6,216,608 B1 4/2001 Woods et al.
6,295,787 B1 10/2001 Lee
6,357,366 B1 3/2002 Frankenberg
D459,049 S 6/2002 Apps et al.
D480,221 S 10/2003 Luciano
6,651,815 B1 11/2003 Koefelda
D487,272 S 3/2004 Korpai
6,708,628 B2 3/2004 Halavais
D489,860 S 5/2004 Apps et al.
D494,337 S 8/2004 Carpenter et al.
6,807,911 B2 10/2004 Carson et al.
6,857,377 B2 2/2005 Herring et al.
6,874,428 B2 4/2005 Apps
6,983,846 B2 1/2006 Koefelda
7,107,601 B2 9/2006 Arai
7,182,897 B2 2/2007 Arai
D550,925 S 9/2007 Boaler et al.
D556,424 S 11/2007 Weise et al.
D556,425 S 11/2007 Weise et al.
D572,676 S 7/2008 Niitsu
7,455,017 B2 * 11/2008 Carpenter ..... B65D 81/054 108/51.11
7,637,219 B2 12/2009 Hartel et al.
D684,379 S 6/2013 Sim
8,671,849 B2 * 3/2014 Krieg ..... D06F 39/001 108/51.11
D728,188 S 4/2015 Fellers
D738,063 S 9/2015 Angel
D760,990 S 7/2016 Baker et al.
9,522,760 B2 * 12/2016 Frankenberg ..... B65D 81/3823
D788,501 S 6/2017 Clark et al.
D796,873 S 9/2017 Clark et al.
D854,343 S 7/2019 Altemimei
10,597,504 B2 3/2020 Naranjo Carvajal et al.
10,780,906 B2 9/2020 Takyar et al.
D901,124 S * 11/2020 Gómez Caudillo ..... D34/38
11,058,109 B1 * 7/2021 Warberg Block ..... A01N 25/10
11,279,516 B2 3/2022 Valdes Abramo et al.
2004/0025757 A1 2/2004 Fan
2004/0118739 A1 6/2004 Koefelda
2005/0059747 A1 3/2005 Berghmans et al.
2006/0049070 A1 * 3/2006 Johanson ..... B65D 19/0002 206/320
2006/0054064 A1 * 3/2006 Miller ..... B65D 19/0095 108/56.1
2006/0201399 A1 9/2006 Swistak et al.
2006/0236903 A1 10/2006 Moore, Jr.
2007/0213416 A1 9/2007 Handa et al.
2008/0066657 A1 * 3/2008 Kuo ..... B65D 19/0095 108/56.3
2008/0115699 A1 * 5/2008 Miller ..... B65D 19/0095 108/56.1
2008/0178775 A1 7/2008 Strobl et al.
2010/0198133 A1 8/2010 Dougherty, Jr. et al.
2010/0218705 A1 9/2010 Mani
2010/0293890 A1 * 11/2010 Pare ..... B65D 81/02 53/139.6
2011/0232538 A1 * 9/2011 Chou ..... F16B 5/065 403/291
2012/0214890 A1 8/2012 Senda
2012/0325125 A1 12/2012 Apps et al.
2013/0174763 A1 * 7/2013 Storteboom ..... B65D 19/0095 108/51.11
2014/0110491 A1 4/2014 Roberts, Jr.
2014/0231429 A1 8/2014 Frankenberg
2014/0283714 A1 9/2014 Wahl
2016/0023803 A1 1/2016 Green et al.
2016/0288951 A1 10/2016 Rader et al.
2016/0368659 A1 12/2016 Bastian et al.
2019/0144163 A1 5/2019 Lim
2019/0359378 A1 11/2019 White et al.
2021/0055152 A1 2/2021 Ekkel
2022/0194657 A1 * 6/2022 Frankenberg ..... B65D 69/00

FOREIGN PATENT DOCUMENTS

EP 0765724 A2 4/1997
EP 1095867 A1 5/2001
EP 2318282 A1 5/2011
GB 2021038 A 11/1979
KR 101498071 B1 3/2015
WO WO 2005/102853 11/2005
WO WO 2006100517 A1 9/2006
WO WO 2009158397 A1 12/2009
WO WO 2010008264 A1 1/2010

* cited by examiner

1

STRUCTURAL SYSTEM FOR LOAD STABILIZATION FRAME AND METHOD FOR ASSEMBLING THE SAME

TECHNICAL FIELD

The present invention relates to a structural system to form a top frame, combinable and/or usable in conjunction with a pallet, particularly, to stabilize, hold, secure and/or fixing a determined load, such as merchandise, products, goods and/or materials during their handling, packaging and/or transportation, that is, the structural system of the present invention is used within the field of material handling. The top frame structural system comprises a set of stringers, whose design and assembly arrangement offers outstanding performance in its structural properties, mainly when the frame is being subjected to bending and torsion forces compared to conventional or currently known top frames, essentially providing an important improvement to stabilize loads during material handling, giving it the ability to be repairable and, in addition, improving transport/packaging efficiency, being that, due to said structural properties, the present invention requires less storage space for its transportation.

BACKGROUND

Within the field of packaging, transportation of goods, merchandise, products and the like, and in general, the field of material handling, the safety of merchandise or goods (which can also be raw materials and not just finished products) is a priority objective. Multiple devices and/or systems have been developed as auxiliaries to ensure the integrity of the products themselves, as well as during their use and implementation for the operations involved.

Normally, the goods are initially placed on pallets (also known as palletizing), managing to build a load unit whose handling can be easily carried out, for example, using or with the help of a forklift. In this sense, once the product is placed and stacked on the pallet, it is stabilized by means of a tension-applied tape, also known as a strap, which restricts the movement or displacement of the product that may result from a maneuver or movement carried out by forklift operators, or equipment of production lines such as conveyor belts or during transport or shipments, thus preventing goods from falling or leaving the formed load unit.

This represents a relevant technical problem, since when the straps are in direct contact with the merchandise, the force they exert on the product can cause unwanted damage. Based on the above, covers and/or top frames have been implemented in order to prevent the straps from damaging the product, always ensuring the function of the strap as previously mentioned. Said covers and/or top frames rest or are placed on the upper terminal portion of the corrugated product and act as an interface between the strip and the product; in this way, the force and/or tension of the strap is applied directly on said lid and/or top frame, safeguarding the integrity of the stacked product.

Then, a great variety of covers and top frames, in combination with a platform, have been used. The best-known types of lids and frames in the product packaging industry are made from corrugated cardboard and, more recently, from plastics. In this sense, numerous frames and/or top covers have showed improvements over time, mainly seeking less weight, less use of material, greater resistance, without reducing the protection of the packaged product.

An example of a lid/top frame is shown in patent application US 20040025757 A1, published on Feb. 12, 2004, which describes a top frame formed by two identical rectangular members, which comprise on one of their surfaces, a portion smooth and/or flat and, on its opposite surface, it has a set of ribs; both rectangular members include a clearing inside, which gives them the characteristic of "frame"; both members are configured to join and form a single frame.

However, the top frame disclosed by US '757 has relevant technical problems. Mainly, its geometry, dimensions and limitation to be formed as a single piece implies greater resources for its manufacture, maintenance and even during its handling or use.

Moreover, document KR101498071 B1, published on Mar. 3, 2015, shows a top frame that, unlike the frame of US '757, the frame of KR '071 is manufactured in a modular way, that is, divided into a set of stringers, and a set of corners, where said corners comprise projections capable of receiving the stringers, and through mechanical means, they can hold and secure the position of the frame, forming a rectangle once each stringer was connected to its respective corner; likewise, the framework disclosed by KR'071 and its modular arrangement opens the possibility of, once the mechanical means have been removed, disassembling the framework and, eventually, replacing a component that has suffered damage and/or whose structural integrity may compromise performance framework overview.

The KR '071 frame, however, presents relevant technical problems derived, mainly, from mechanical resistance due to the geometry and design of the coupling interfaces between the corners and the stringers. A person skilled in the art will be able to observe that the excess or projecting surface of each corner connecting with a respective stringer, although it has an arrangement of ribs, a reduced projecting length as shown in KR '071 would imply a possible concentration of stress, mainly in the presence of a force causing torsion; thus, it is clear that the strength of the connecting corners could easily fail and compromise the integrity of the stringers and/or the frame in general.

Based on the foregoing, the modular distribution of components, as disclosed by KR'071, offers advantages with respect to what was initially proposed by US'757, however, there is a need for devices that, first of all, offer higher mechanical resistance. It is convenient to provide a top frame whose modular composition offers advantages during the manufacturing, handling and transportation process, but it is also convenient that its mechanical properties are not compromised.

Likewise, the device disclosed by KR'071, as briefly described, then comprises a total of four corners and four stringers, with a total of eight pieces required to form a top frame; based on the above, it is convenient to provide a device with a smaller number of components required to form the frame.

SUMMARY

It is therefore an object of the present invention to provide a top frame-type structural system which can be placed on any merchandise, goods and/or products, and in combination with a pallet and a strap, the structural system is capable of supporting, containing and/or fixing said merchandise, goods and/or products, ensuring its integrity, and, mainly, wherein said top frame-type device is formed in a modular manner.

In this sense, by "modular" should be understood the top frame to be provided which can comprise a plurality of pieces (modules) that, when joined or coupled together, form the frame, in an operative or ready-to-use configuration.

Thus, it is known that the current and/or commercially available top frames, normally, being formed in a single piece (monolithic), during their transport/packaging can occupy an excess of space, then limiting the capacity of frames that can be transported. Therefore, it is an additional object of the present invention to provide a top frame-type structural system that, based on the modular design, provides a simple and productive solution to reduce packaging space, advantageously increasing the number of top frames. that can be transported, thus increasing the efficiency of the use of space, and in general, of the logistics and transportation of structural systems.

Also, another object of the present invention is to provide a top frame-type structural system that requires a minimum number of modules and/or components to be formed in its entirety or in an operative configuration.

Another object of the present invention is to provide a top frame-type structural system, in which the plurality of modules have a disposition, geometry, arrangement or configuration that favors its structural properties, said structural system being capable of offering a top frame with high stabilization, then, being auxiliary to stabilize the load/merchandise, and being capable of resisting torsion and bending forces and thus, offering a top frame with a greater number of cycles of use.

An additional object of the present invention is to provide a top frame-type structural system comprising an assembly and/or separation system capable of improving the coupling, connection and/or interaction between its different modules increasing the resistance to the deformations resulting from the application of force by the strap directly on the frame in its operating configuration.

On the other hand, it is known that monolithic top frames (or manufactured as a single piece) once they suffer damage to a portion thereof, their general structural integrity is seriously altered, causing the entire frame to be completely unusable. Therefore, another object of the present invention is to provide a top frame-type structural system, which, based on the previously mentioned configuration and modular design, advantageously helps the separation of the different modules, so that, for example, when a single section has been damaged or its structural properties have been compromised/reduced, said damaged sections can be removed from the other modules and, consequently, can be replaced/substituted by a new section/module; thus, the structural system of the present invention can be considered repairable, which directly affects the useful life of the system in general, providing a greater number of cycles of use.

DETAILED DESCRIPTION

Figure 1:
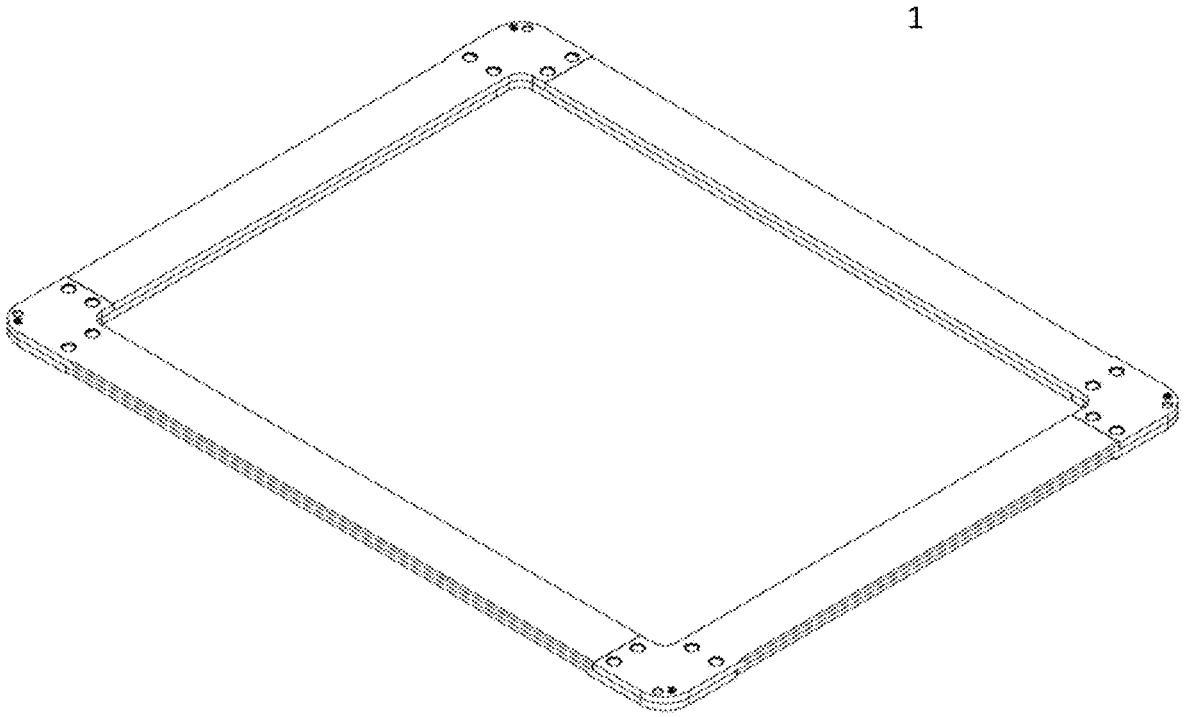
FIG. 1 is an upper front perspective view, showing the structural system according to one embodiment of the present invention.
Figure 2:
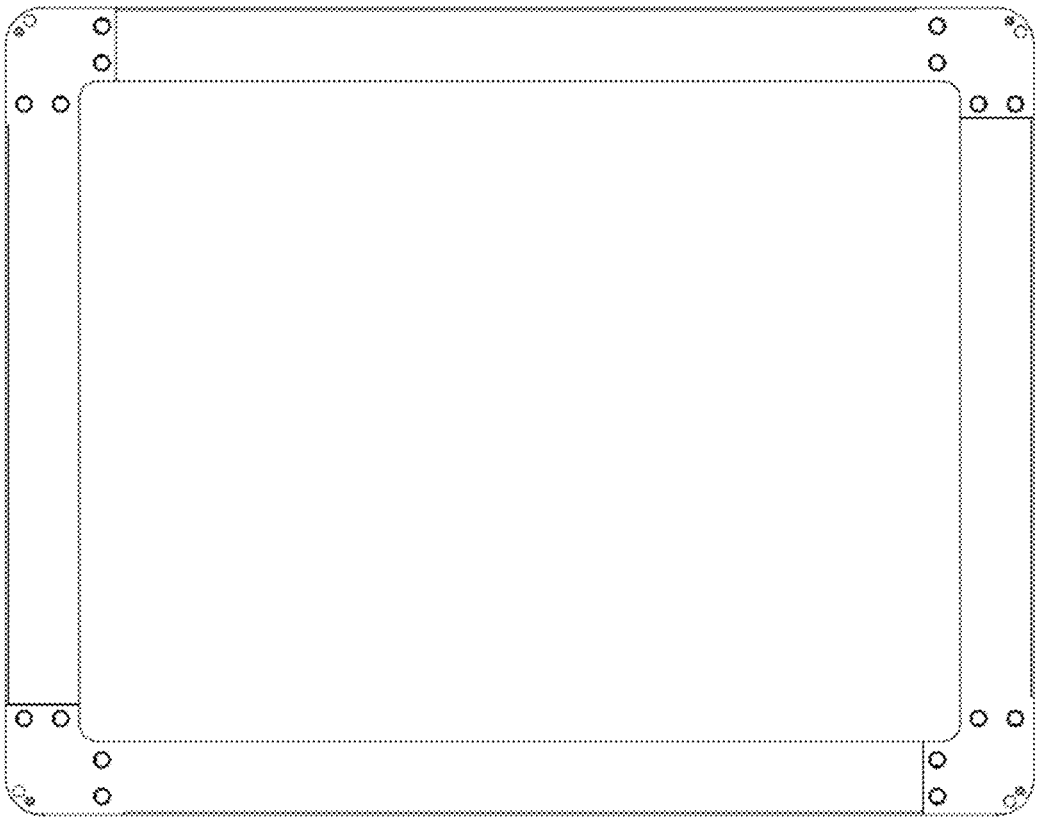
FIG. 2 is a front elevation view of the structural system shown in FIG. 1.
Figure 3:
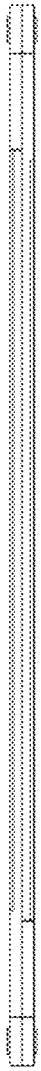
FIG. 3 is a right-side elevational view of the structural system shown in FIG. 1.

Some aspects of the present invention will now be described in more detail using further reference to the accompanying drawings in which some embodiments and advantages of the present invention are shown.

It will be apparent to one skilled in the art that various embodiments of the invention may be expressed in different ways and should not be construed as being limited to the embodiments described herein; rather, these exemplary embodiments are provided so that this invention is clear and complete, and fully conveys the scope of the invention to those skilled in the art. For example, unless otherwise stated, something described as first, second, or the like should not be construed as a particular order. As used in the description and the appended claims, the singular forms "a", ", "an", "the", include plural referents unless the context clearly indicates otherwise.

The different aspects of the present invention refer to a top frame-type structural system for load fixing; The present invention can be used together with pallets that can support a product/merchandise or goods, which are stowed and/or palletized, and later, fastened/fixed through a rope, tape and/or strap. In particular, the top frame of the present invention is configured to mechanically interact with the strap and efficiently distribute the generated stresses derived from the force to which it is subjected to ensure the integrity and bracing of the product.

The present invention comprises a set of structural components, manufactured in a modular manner, which can be assembled and disassembled, offering a practical product, easy to handle and transport, and specifically, being manufactured in a modular manner. The structural system of the present invention can be advantageously transported, packaged using less space, thus improving its logistics and handling.

Additionally, the modular design of the structural system of the present invention offers a superior frame solution with desirable mechanical properties, that is, once the modular system is in an operational configuration, its structural and mechanical properties are outstanding, even compared to conventional models of monolithic top frames.

In the context of the present invention, "top frame for load fixing" should be understood as a device that can be placed on an upper portion of a product, merchandise and/or goods (hereinafter, also referred to only as product, or merchandise or goods), stacked or in an arrangement also known as palletizing, which is placed on a pallet.

"Pallet" can be understood as any type of base known and commonly used to contain, store and transport products, which are widely known in the field of packaging and transport of goods, handling and distribution, as well as handling of products. A "pallet", in the context of the present invention, can be any type of platform/pallet, for example, made from wood, metal, plastic or a combination thereof. Preferably, the pallet is a base made from any plastic.

Likewise, "strapping" should be understood as any means known and/or commonly used in the field of packaging, transport, manipulation and handling of products, which is configured to be connected solidly, at one end, to a base and/or pallet and, on the other end, to the top frame of the present invention, and whose function is, by means of the tension exerted on said base/pallet and top frame, to secure and fixing the position of the propped product, avoiding and/or reducing the possibility of movement of said product when is transported or handled. In this sense, straps can be one or a plurality of cords, straps, belts, ties, or the like, without any limitation to those previously mentioned.

Figure 4:
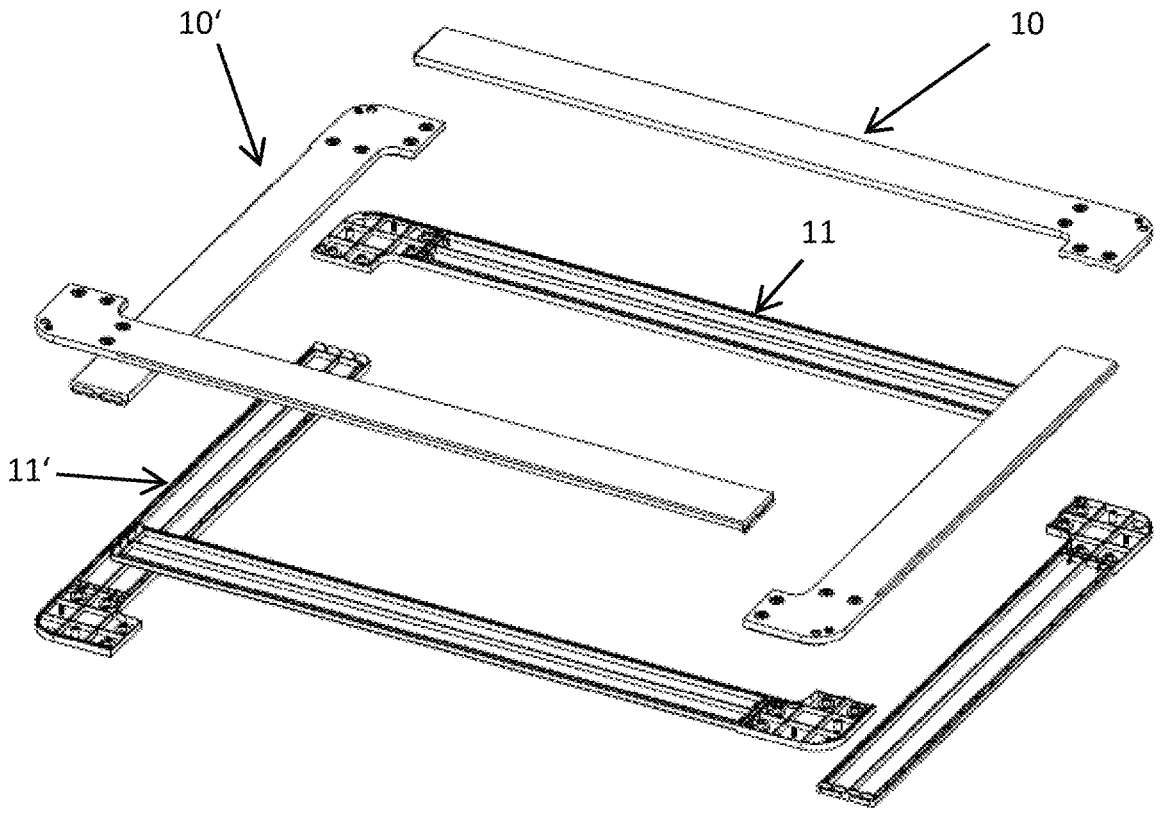
FIG. 4 is an exploded view in upper front perspective according to one embodiment of the structural system, where the stringers are separated or in a configuration prior to their assembly to form the final stringers.

Furthermore, the top frame-type structural system (1) of the present invention, as can be seen in FIGS. 1 and 4, comprises a portion of primary and secondary stringers (10, 10' and 11, 11'), which, in turn, are formed by an upper portion (10, 10') and a lower portion (11, 11').

Figure 7:
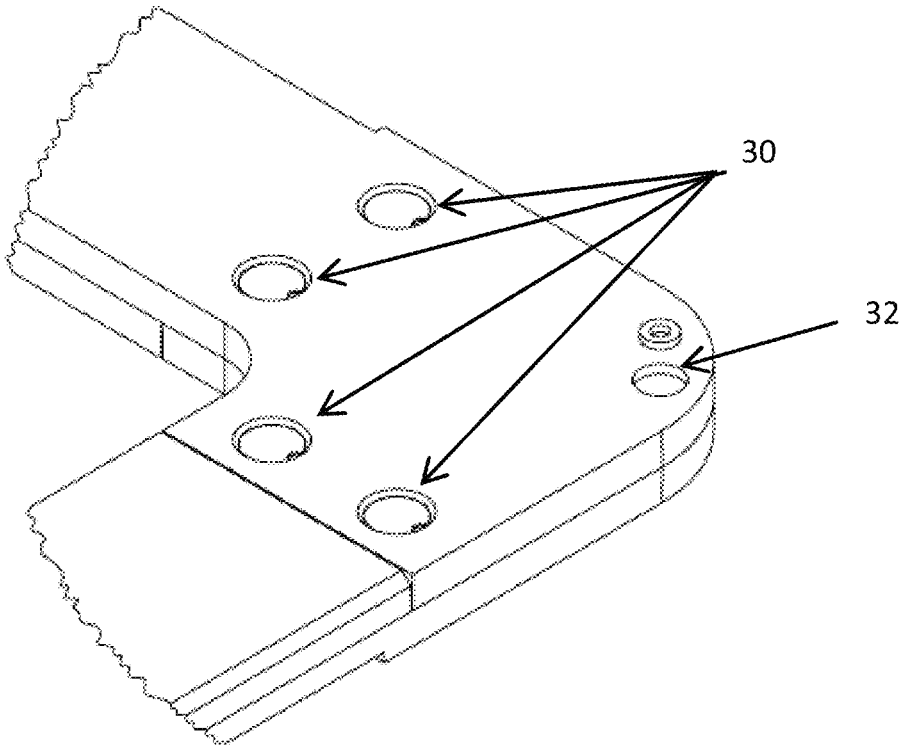
FIG. 7 is an isometric perspective detail view of a corner portion of both upper and lower final stringers, when they are joined together, prior to placing the fastening means of the assembly and/or separation system in the respective receivers.
Figure 9A:
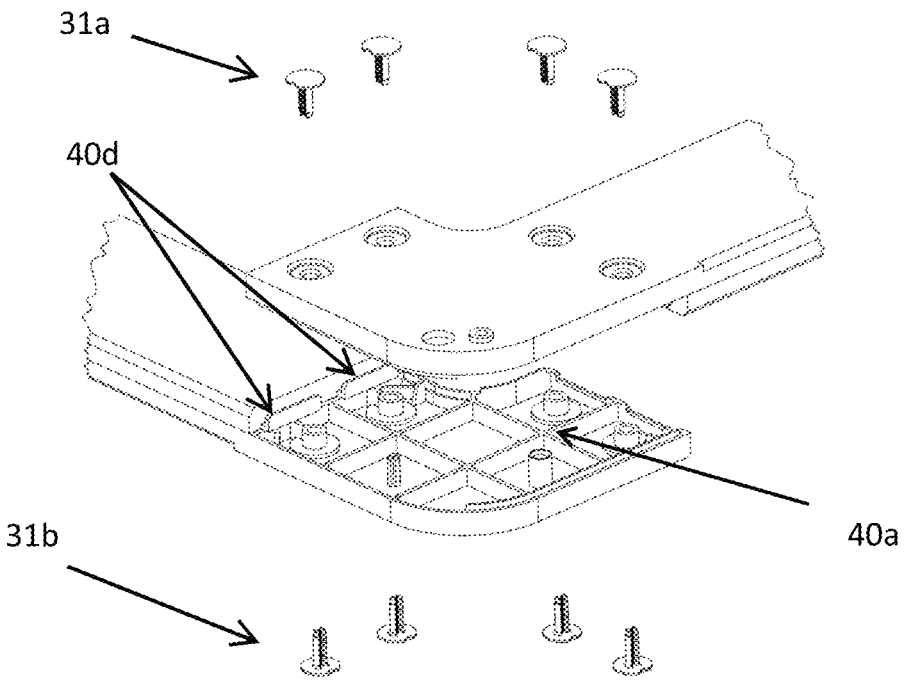
FIGS. 9*a* and 9*b* show a detailed view of the corner portion of the upper and lower final stringers, showing the fastening means in their respective position prior to being placed in the respective receivers.

In a preferred embodiment, both the primary and secondary stringer portions are formed by a straight zone and a corner zone, forming an "L" type. As can be seen in FIGS. 7, 9*a* and/or 9*b*, the corner area corresponds to the portion of the stringers comprising a plurality of holes (30), said holes are part of an assembly and/or separation system (31), as will be described below in the present disclosure.

In this sense, it should be understood that "plurality of holes" are arranged in the corner zone of the primary and secondary stringers, that is, in said corner zone, at least two and up to "n" number of holes can be arranged, distributed in a uniform manner and/or in a different arrangement than that shown in the previously referred Figures.

Said holes (30) have any appropriate dimension. As a non-limiting example, the holes (30) have a diameter ranging from ⅛ inch to 1 inch; likewise, said holes (30) have a machining or machining-type finish such as countersink, chamfer (as shown in the referred Figure), flared and/or combinations thereof. However, other types of finishes can be used, considering different diameters, depths and angles without being limited to those previously mentioned.

In an optional embodiment, the stringers may also comprise at least one and up to "n" number of anti-skid element receiving holes (32), which are configured to fit inside, holding and/or fixing an anti-skid element (not shown), which can provide anti-slip properties, for example, when one or more top frames (1) are abutted.

Figure 10:
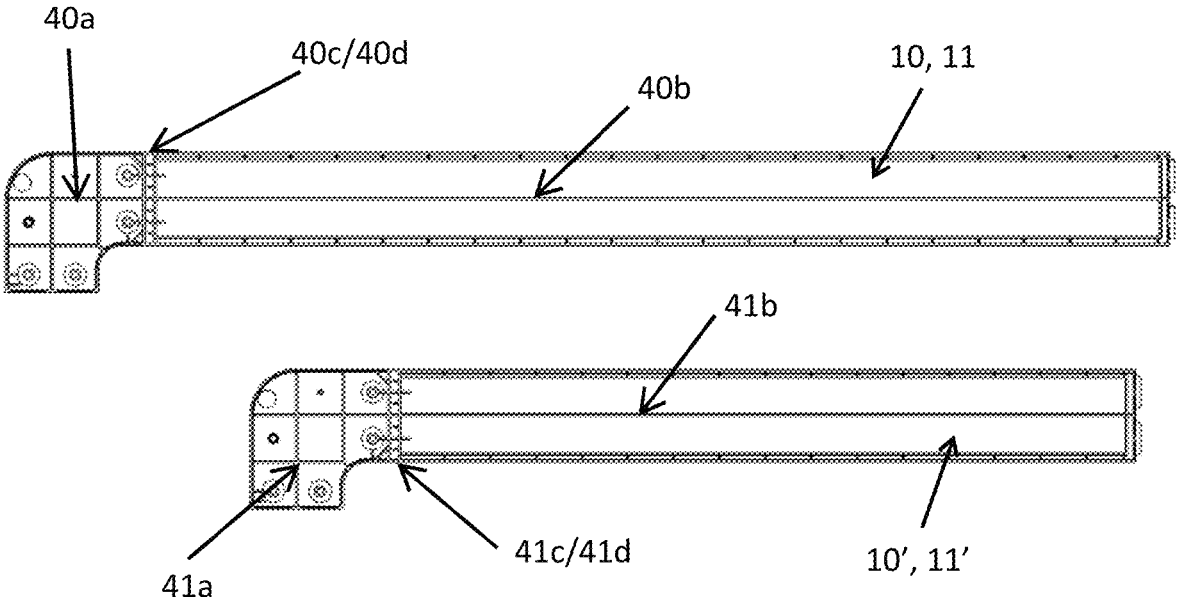
FIG. 10 shows a bottom view of a primary beam portion and a secondary beam portion, according to one embodiment of the present invention.

Additionally, in one embodiment, both the upper (10, 10') and lower (11, 11') portions of the primary and secondary stringers are formed by an arrangement of ribs, arranged in a lower and/or inner part, such as shown in FIG. 10.

In the context of the present invention, "rib arrangement" should be understood as a matrix or arrangement of walls arranged in a certain geometry, dimension, thickness and distribution, integrally formed with the primary and secondary stringers respectively, whose function is to provide them with greater resistance to said stringers. A person skilled in the art will understand that said matrix or arrangement called rib arrangement has any distribution, for example and not limited to, a rectangular/square arrangement, such as the one illustrated in the referred Figure. Other distributions can be used, such as and not limited to regular distributions forming polygons, irregular distributions, continuous or discontinuous distributions, variable combinations, where they are used, in different areas of the arrangement, different sizes, thicknesses, among others.

In one embodiment, the rib arrangement is divided into two zones, one corresponding to the corner (40*a*, 41*a*) and the other corresponding to the straight zone (40*b*, 41*b*). By "divided" should be understood the arrangement of ribs of said corner and straight zones previously referred may be different from each other, using the different distributions previously mentioned; however, said zones may have rib arrangements that form a continuous matrix or pattern.

In one embodiment, the straight zone may comprise a straight unitary rib arrangement (40*b*, 41*b*) and the corner zone may comprise a rib arrangement (40*a*, 41*a*) forming a square/rectangular pattern as shown in FIG. 10; however, as previously mentioned, said rib arrangements (40*a*, 40*b* and 41*a*, 41*b*) are not limited to what is illustrated in the referred Figures.

In a preferred embodiment, the upper stringer (10, 10') can even comprise an arrangement of ribs (40*a*, 40*b* and 41*a*, 41*b*) equal to and corresponding to the arrangement of ribs of the lower stringer (11, 11'), for both primary and secondary stringers. Other types of distributions, matrices and/or arrangements may be possible.

In another embodiment, the upper stringer (10, 10') may comprise an arrangement of ribs (40*a*, 40*b* and 41*a*, 41*b*) totally different from the arrangement of ribs of the lower stringer (11, 11') and the primary and secondary stringers distribution show a mirror view.

On the contrary, in an additional embodiment, the primary stringers can have a totally different arrangement of ribs than those of the secondary stringers, as well as other combinations.

In an optional embodiment, both upper and lower stringers (10, 10', 11, 11') may not comprise any arrangement of ribs inside, being substantially hollow or smooth.

In a further embodiment, each of the primary and secondary portions may comprise a reinforcing section and/or interface (40*c*, 41*c*), characterized as an area with a more concentrated wall geometry and/or shape as shown in FIG. 10; said reinforcing section/interface (40*c*, 41*c*) provides an area of greater material, where a person skilled in the art will clearly understand that said section/interface will allow a greater efficiency of distribution of stresses present during a mechanical interaction between the top frame (1) and strapping; this section/interface (40*c*, 41*c*) can comprise any geometry, dimension and distribution, and is not necessarily limited to what is shown in the referred Figure.

In an optional embodiment, both upper and lower stringers (10, 10', 11, 11') may not comprise any reinforcing section and/or interface (40*c*, 41*c*), thereby preventing the overall weight of the structural system of the present invention suffers an undesired weight gain.

On the other hand, in one embodiment, both the upper (10, 10') and lower (11, 11') portions of the primary and secondary stringers are formed by a smooth surface, arranged on an upper and/or outer part, as can be seen in any of the Figures accompanying this description.

By "smooth surface" is meant a continuous surface, without irregularities and/or bodies present along said upper and/or outer part of both primary and secondary stringers; said smooth surface is configured to contact the strip.

Although, the term "upper and/or outer part" has been used, as well as "lower and/or inner part", these should be interpreted as the upper and/or outer part of the upper and lower stringer corresponding to the smooth surface. Although in the Figures one is shown inverted with respect to the other, and correspondingly, the lower and/or inner part corresponds to the area with the presence of an arrangement of ribs in the corner and straight area, respectively, for both stringers upper, lower, primary and secondary. As an example, to facilitate the understanding of this feature, both primary and secondary stringers can be rotated 180°, and the former lower stringer will remain as the upper stringer, retaining each and every one of the characteristics previously indicated in the present disclosure without any alteration.

In a preferred embodiment, the upper and lower stringer portions (10, 11) of the primary stringers comprise the same length, width and geometry as each other, in such a way that, when splicing them or arranging them one on top of the other, making contact with their respective lower and/or internal parts, (arranged parts of the rib arrangement (40*a*, 40*b* of 10, 11)), both upper and lower portions (10, 11) coincide in their entirety.

Likewise, in a preferred embodiment, the portions of the upper and lower stringers (10', 11') of the secondary stringers comprise the same length, width and geometry as each other, in such a way that, when joining them or arranging them one on top of the other, making contact their respective lower and/or internal parts (parts arranged in the rib arrangement (41*a*, 41*b* of 10', 11')), both upper and lower portions (10', 11') match in their entirety.

In one embodiment, the primary stringers have the same length, width, and geometry as the secondary stringers. In a preferred embodiment, the primary stringers have the same width and geometry as the secondary stringers, but do not share the same length. In an even more preferred embodiment, the primary stringers have the same width and geometry as the secondary stringers, the primary stringers being longer than the secondary stringers. In a preferred embodiment, the upper and lower stringer portions (10,11) of the primary stringers are joined together, as shown in FIG. 5*b*. Correspondingly, the upper and lower rail portions (10', 11') of the secondary rails are joined together.

In one embodiment, the upper and lower stringers (10', 11') on both the primary and/or secondary stringers may each comprise at least two flanges (40*d*); these flanges (40*d*) are arranged in one and/or both end portions of the stringers, as shown in FIG. 9*a*. Thus, once the upper and lower portions are joined or arranged facing each other to form the final stringers, the flange (40*d*) of the upper stringer is connected, coupled, or in general, creates mechanical interference with the corresponding flange (40*d*) of the lower stringer in the manner of a crimp-type coupling; this helps to create a firmer bond between the upper and lower portions by forming the final upper and lower rails.

In one embodiment, the flanges (40*d*) can be incorporated as intermittent portions as seen in the previously mentioned Figures, having at least two and up to "n" number of flanges separated from each other by a distance ranging from 1 mm and up to 25 mm. In another embodiment, a single flange 40*d* (not shown) that can span from one side end to the other side end may be incorporated into the upper and lower stringer respectively.

In a preferred embodiment, once said upper and lower portions are spliced together, the corresponding rib arrangements, which may be identical to the arrangement of the upper stringer portion with the corresponding lower stringer for both primary and secondary stringer, the walls of the arrangement come into contact with each other with their corresponding upper and/or lower ones and coinciding in their entirety. This contributes to each point of contact being auxiliary to distribute the stresses generated by the mechanical interaction between the top frame (1) and the strap, thereby substantially and advantageously increasing the general mechanical resistance of the frame (1).

Although it was mentioned that said mechanical advantage arises when both rib arrangements of the upper and lower portion coincide, this effect may also be present in additional embodiments, e.g., when the arrangements are totally different, and clearly there will be areas where the walls of the upper arrangement will coincide with the lower one, then, the same stress distribution effect previously mentioned is achieved.

Also, once said upper and lower portions are joined, the corresponding reinforcing sections/interfaces (40*c*, 41) located between and/or separating the corner and straight zones, respectively, can also coincide during referred splice, helping to distribute the stresses generated by the mechanical interaction between the top frame (1) and the strip, as previously described.

Referring again to FIG. 5*a* and/or FIG. 9*a*, when said respective upper and lower portions of the primary (10,11) and secondary (10', 11') stringers join each other, the straight zones splice in their totality, leaving the corner areas free or protruding; subsequently, once the upper and lower portions of both primary and secondary stringers have been joined, said portions are subjected to a permanent coupling treatment, thus forming a main (20) and secondary (20) final stringer. 20') respectively.

By "permanent coupling treatment" should be understood a joining process or method that allows permanently joining both upper and lower portions; such processes or methods may be and are not limited to ultrasonic welding processes, linear and orbital type vibration welders, hot plate welders, combinations thereof and/or the like.

In this sense, the combination of the upper and lower portions is called the "final stringer", once it is permanently joined by the previously mentioned coupling treatment, thus achieving a single piece where the person skilled in the art can clearly determine that, based on the combination of geometries, sizes, widths and, mainly, the incorporation and interaction of the rib arrangements as described herein, provides said final stringer with improved mechanical properties.

After the permanent coupling treatment, a main final stringer is obtained (the result of combining a portion of the main upper and lower stringer (10,11)) and a secondary final stringer (the result of combining a portion of the upper and lower stringer (10', 11') secondary); as shown, respectively, in FIG. 5*b*.

In one embodiment, each of the primary and secondary portions referred herein can be made of an appropriate plastic material, such as any material selected from the group comprising polyethylene terephthalate (PER or PETE), high-density polyethylene (HDPE), low density polyethylene (LDPE), polypropylene (PP), polystyrene (PS), ASA, ABS, as well as thermoplastic reinforced plastic materials, combinations thereof and/or similar.

Moreover, each of the primary and secondary portions referred in the present disclosure can be manufactured with lengths ranging from 5 inches to 70 inches, with widths ranging from 3 inches to 15 inches; likewise, said primary and secondary portions may have a thickness and/or height ranging from ½ inch and up to 5 inches.

Additionally, each of the primary and secondary portions herein may be manufactured by any appropriate production/manufacturing means, such as and not limited to injection and/or extrusion molding, blow molding, vacuum molding, rotation, polymer casting, three-dimensional printing, gas-assisted injection, a combination thereof and/or the like.

Figure 6A:
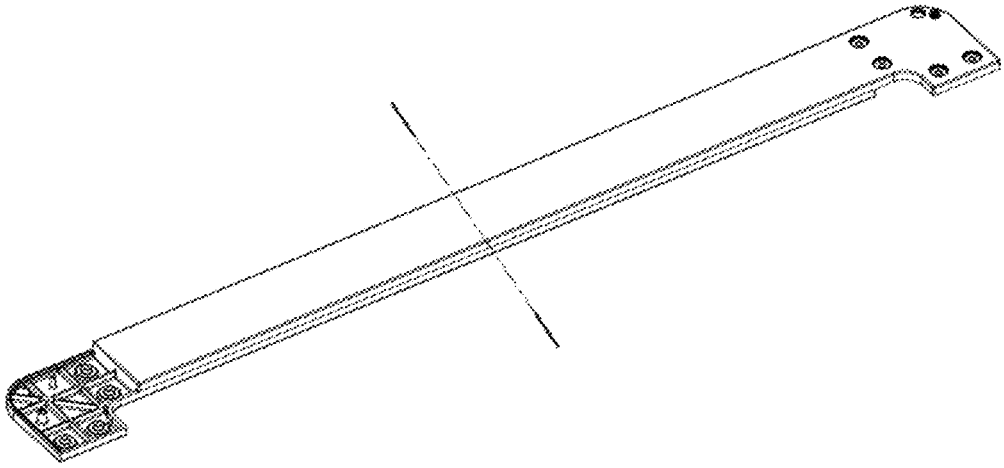
FIG. 6*a* illustrates an isometric perspective view of a final stringer, according to a preferred embodiment of the present invention, where said end stringer is directly manufactured in a single piece.
Figure 6B:
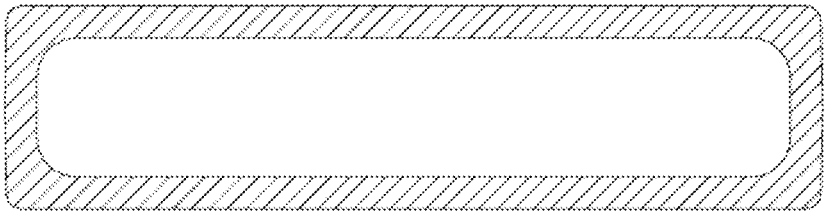
FIG. 6*b* is a cross-sectional view of the final stringer of FIG. 6*a*, according to a preferred embodiment of the present invention.

In an even more preferred embodiment, the structural system of the present invention can be manufactured by any of the previously mentioned manufacturing/production means, or the final primary and secondary stringers can be manufactured directly, avoiding carrying out the coupling treatment previously described. By "directly", should be understood that it is possible to produce the primary and secondary stringers, as shown in FIG. 6*a*, and as previously named and explained, in their final form, directly from the manufacturing/production process, keeping each of the elements and characteristics as described herein.

In this sense, according to this even more preferred embodiment, when the final stringers are formed directly from the manufacturing process, it is not necessary to carry out a permanent coupling treatment, since, repeatedly, the final stringers would come out directly from the manufacturing process "in one piece", having each and every one of the characteristics described in the present disclosure. The final stringers formed according to this embodiment may be completely hollow, and therefore avoiding any rib arrangement.

Likewise, the final stringers according to this embodiment can be formed by any of the previously mentioned production methods, as well as any of the materials and combinations of materials mentioned in the present application.

Moreover, each of the final stringers according to this embodiment can be manufactured with lengths ranging from 5 inches to 70 inches, with widths ranging from 3 inches to 15 inches and heights ranging from 1 inch to 10 inches.

Figure 5A:
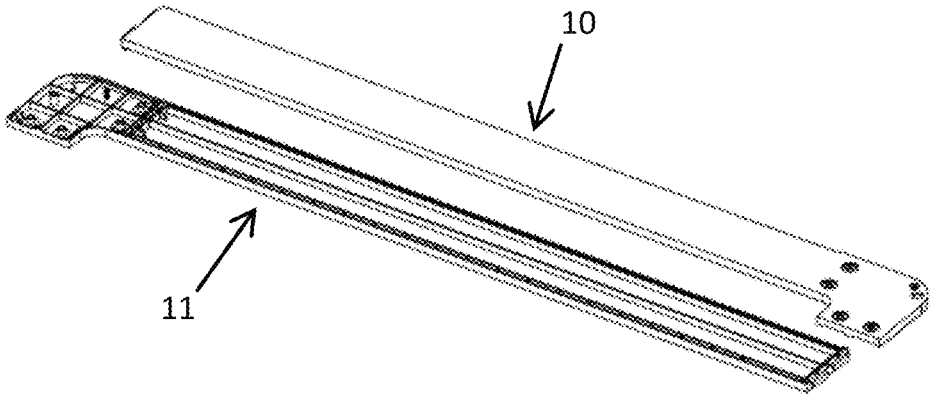
FIG. 5*a* shows an isometric perspective view of a portion of the upper and lower stringer, according to one embodiment of the present invention, prior to their assembly between them.
Figure 5B:
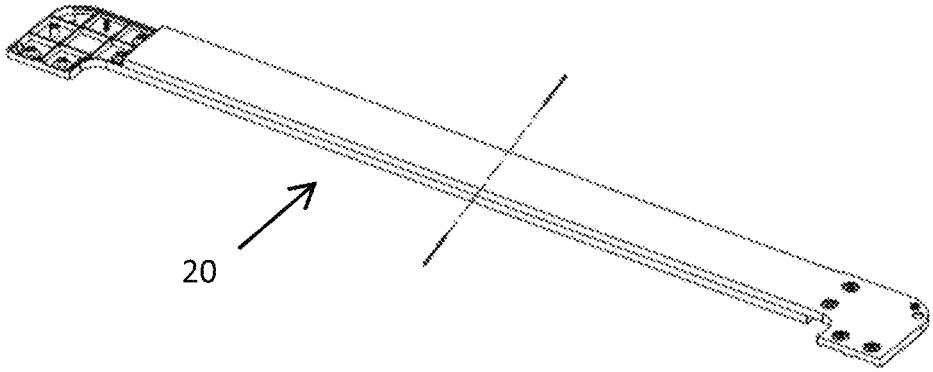
FIG. 5*b* shows an isometric perspective view of a final stringer, according to one embodiment of the present invention, where the upper and lower stringer portions of FIG. 5*a* have been joined.
Figure 5C:
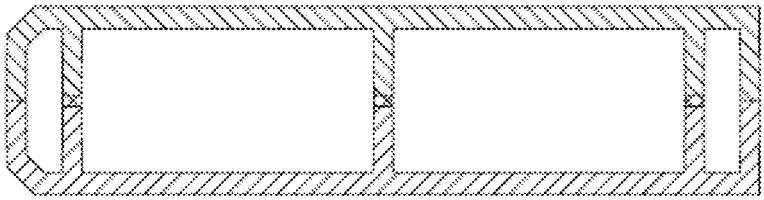
FIG. 5*c* is a cross-sectional view of the final stringer of FIG. 5*b*, according to one embodiment of the present invention.
Figure 8:
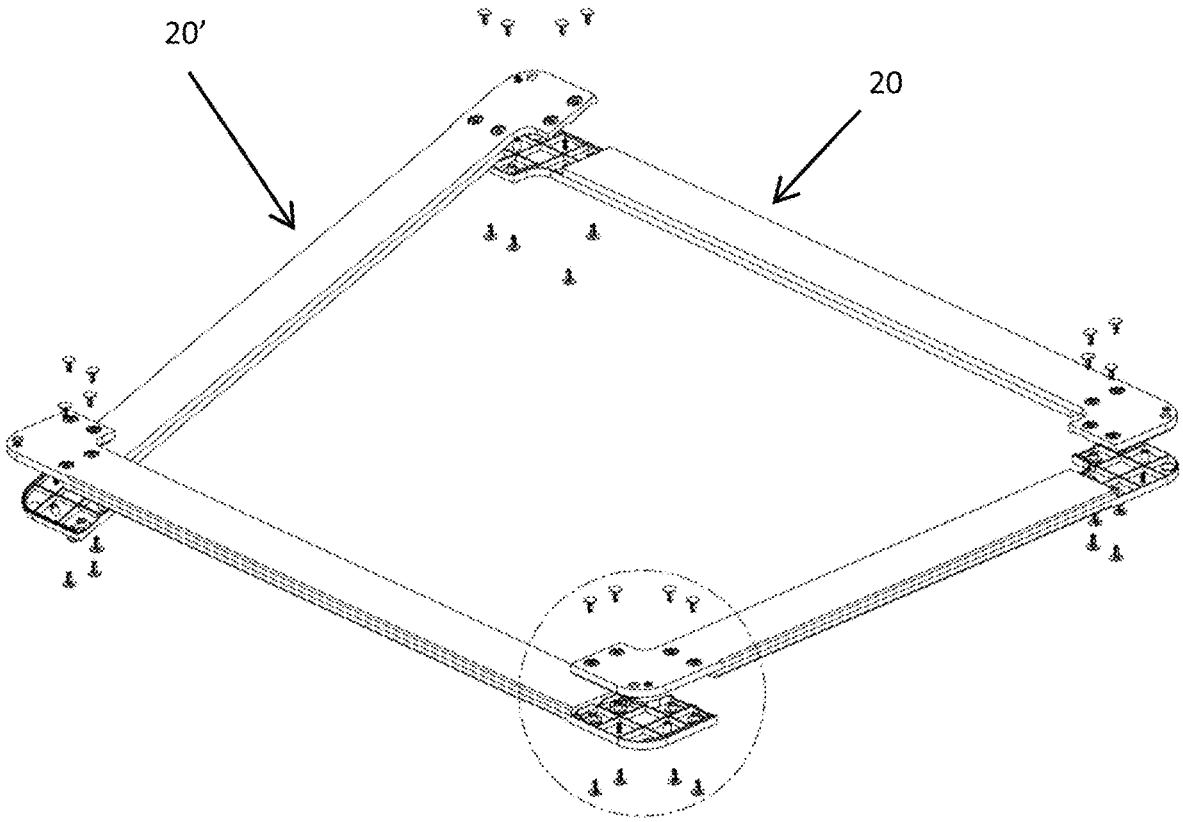
FIG. 8 is an isometric perspective view, illustrating the positioning of the final stringers and their respective corner portions to achieve assembly and switching to an operating state of the structural system of the present invention.

Once the final primary and secondary stringers have been formed, regardless of the embodiment, but taking into account the characteristics and, mainly, the previously mentioned splice configuration, that is, where the straight areas of both portions of the stringers coincide in their entirety, causing the corner areas to protrude as shown in FIGS. 5*a* and/or 6*a*, which occurs in any of the embodiments described in this document. It is then at this point that the invention comprises the minimum elements form the top frame (1), being, as shown in FIG. 8, two main final stringers (20) and two secondary final stringers (20').

Figure 9B:
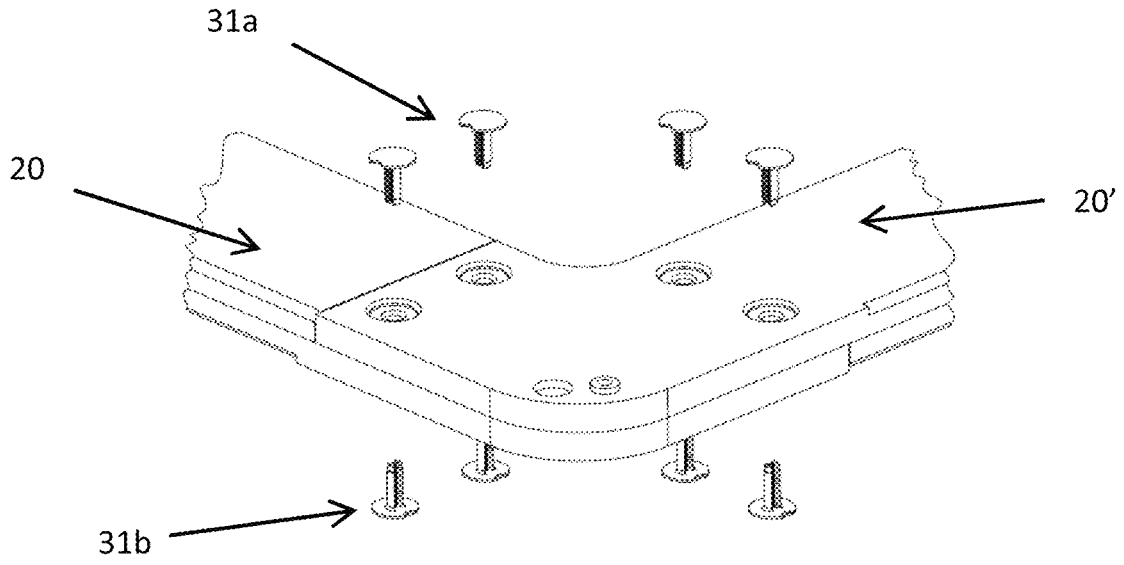

In a preferred embodiment, a corner zone of a main final stringer (20) is arranged on a corner zone of a secondary final stringer (20'), in such a way that the joint of said corner zone of the main final stringer (20) fully covers the corner area of the secondary final stringer (20'), then repeating this action for each of the four corner areas, resulting in the formation of the frame (1) as shown in FIGS. 9*a* and 9*b*.

Figure 9C:
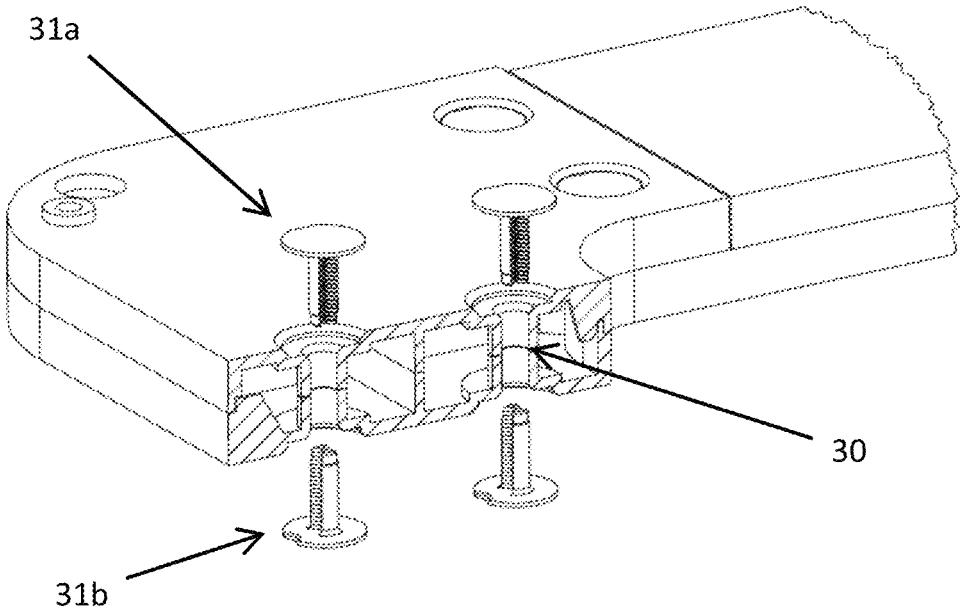
FIG. 9*c* illustrates a cross-sectional detail view of the corner portion of the upper and lower final stringers, showing the fastening means in their respective position prior to being placed in the respective receivers.
Figure 9D:
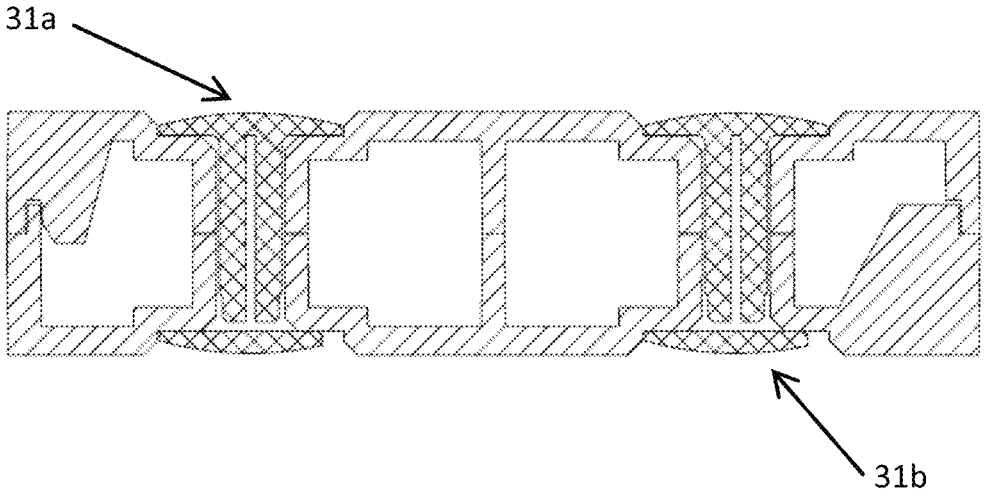
FIG. 9*d* is a cross-sectional view of the corner portion of the upper and lower final stringers, where the fastening means have already been inserted into their respective receivers and therefore, the structural system of the present invention is in an assembled configuration.

Finally, to ensure a correct hyperstatic coupling between each main and secondary final stringers, an assembly and/or separation system (31) integrated, firstly, by a plurality of receiving holes (30), as shown in FIGS. 9*c* and 9*d*, allows each stringer to be fixed and maintained in the previously mentioned coupling and arrangement. In a preferred embodiment, the assembly and/or separation system (31) previously described uses ratchet-type rivets as a means of mechanical interaction; however, other known means may be used, such as and not limited to hot rivets, screws, pins, combinations thereof, and/or the like.

In an even more preferred embodiment and with reference to FIGS. 9*a* to 9*d*, said assembly and/or separation element (31) is divided into upper fastening means (31*a*) and lower fastening means (31*b*), which are placed inside the receiving holes (30) as shown in FIG. 9*d*, that is, the upper fastening means (31*a*) are in an opposite orientation to the lower fastening means (31*b*), thus achieving to conform the top frame (1) in an operative configuration.

In an optional embodiment, and in order to provide preventive or corrective maintenance to the top frame (1) of the present invention, advantageously, the assembly and/or separation system (31) can be removed by a user, without damaging the stringer or set of associated final stringers, thus managing to replace a final stringer, for example, after a certain number of cycles of use, and/or in the presence of a failure or reduction in its structural strength, in order to safeguard the integrity of the frame (1) and thereby advantageously and considerably increasing its useful/average life. As a non-limiting example, the assembly and/or separation system can be removed by roughing, using a drill-type tooling, so a user will be able to rough and remove the clamping members (31), and advantageously, the corner areas of the primary and secondary final stringer involved will not suffer any damage.

It will be apparent for the person skilled in the art that the combination of the different mechanical interactions between the different components of the top frame-type structural system (1) of the present invention provides outstanding structural properties, and, certainly, offers sufficient resistance and mechanical performance to meet each of the operational requirements to which it is subjected, which will be even more evident taking into account the experimental results that will be presented below.

In addition to the mechanical and structural interaction derived from the different characteristics that comprise the portions of the main and secondary stringers and even more so the subsequently formed main and secondary end stringers, the applicant has discovered that, advantageously, the interaction of the corner zones, as previously described, and in combination with the previously mentioned characteristics of the stringers and the assembly and/or separation system (31), offer a structural system with the capability to increase efficiency during logistics, transporting and packaging of the same, being that the characteristic of being collapsible, allows the structural system to occupy less space, and on the other hand, this characteristic does not reduce, limit or condition its operational performance, being that, the structural system of the present invention comprises desirable mechanical properties once it is in its operational configuration being used in any material handling procedure.

Furthermore, it is clear that the decoupling capacity of the structural system of the present invention, that is, the final stringers can be disassembled, passing from an operational configuration to a packaging one, in addition to favoring logistics, as previously mentioned, provides greater resistance and average life/number of cycles of use, since, in the event that a final stringer suffers significant damage or when its integrity is compromised, it can be replaced with a new one and the rest of stringers that did not suffer any damage can continue to operate in an ordinary way, now interacting with the replacement of the damaged stringer; this translates into improved and increased overall structural system life, as well as a significant reduction in operating costs compared to, for example, monolithic top frames, which, once damaged in any portion thereof, may be completely unusable.

It will be evident for a person skilled in the art, based on the present disclosure that by assigning a coupling surface as wide as the corner areas of the main and secondary final stringer of the present invention, independently of the chosen embodiment, together with the arrangement of the assembly and/or separation system (31) as previously described, the stress distribution is outstanding, allowing a coupling between the final stringers, mainly ensuring firmness and stability.

Bearing in mind the experimental results that will be demonstrated below. It will be evident that the innovative and novel configuration disclosed by the applicant offers a top frame (1) with superior and advantageous structural properties, even in the presence of forces, tension and bending stress. Based on the configuration and arrangement as described in the present application, the substantial improvement provided in the transport logistics of the system in its disassembled or non-operative configuration will be evident.

EXAMPLES

Figure 14A:
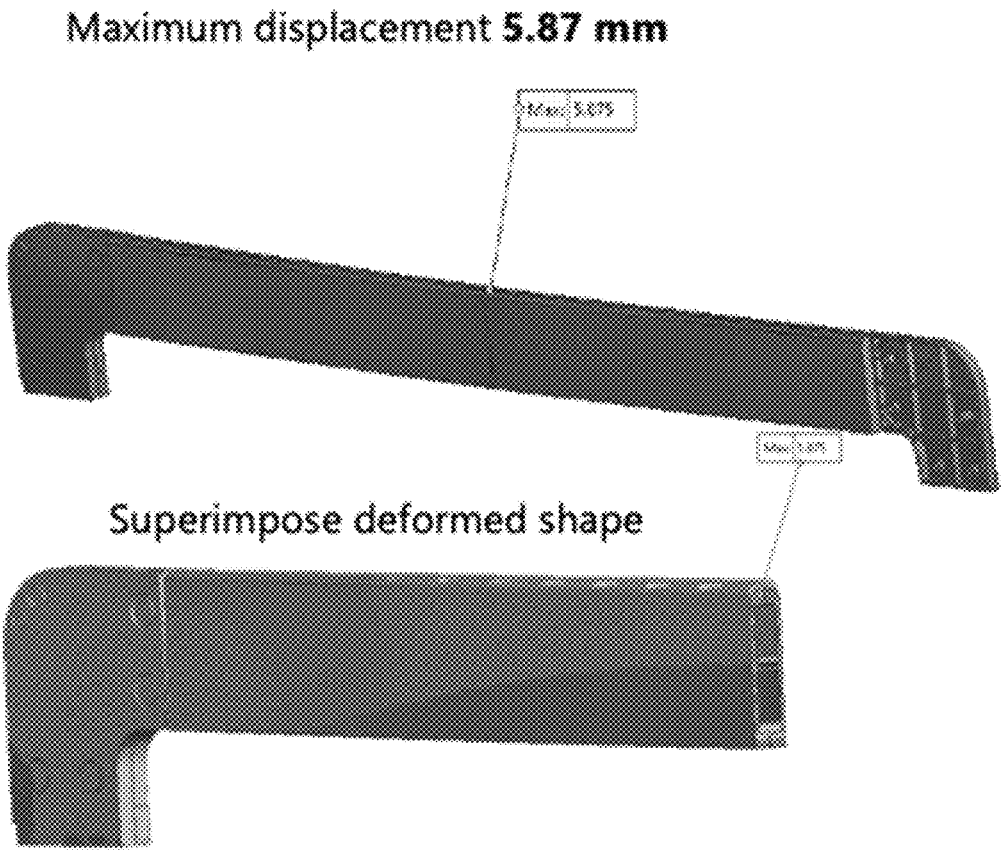
FIG. 14*a* is a graphic representation of a Finite Element Analysis (FEA) applied to the structural system of the present invention, wherein the area of greatest displacement is shown, once a force has been exerted on it.
Figure 14B:
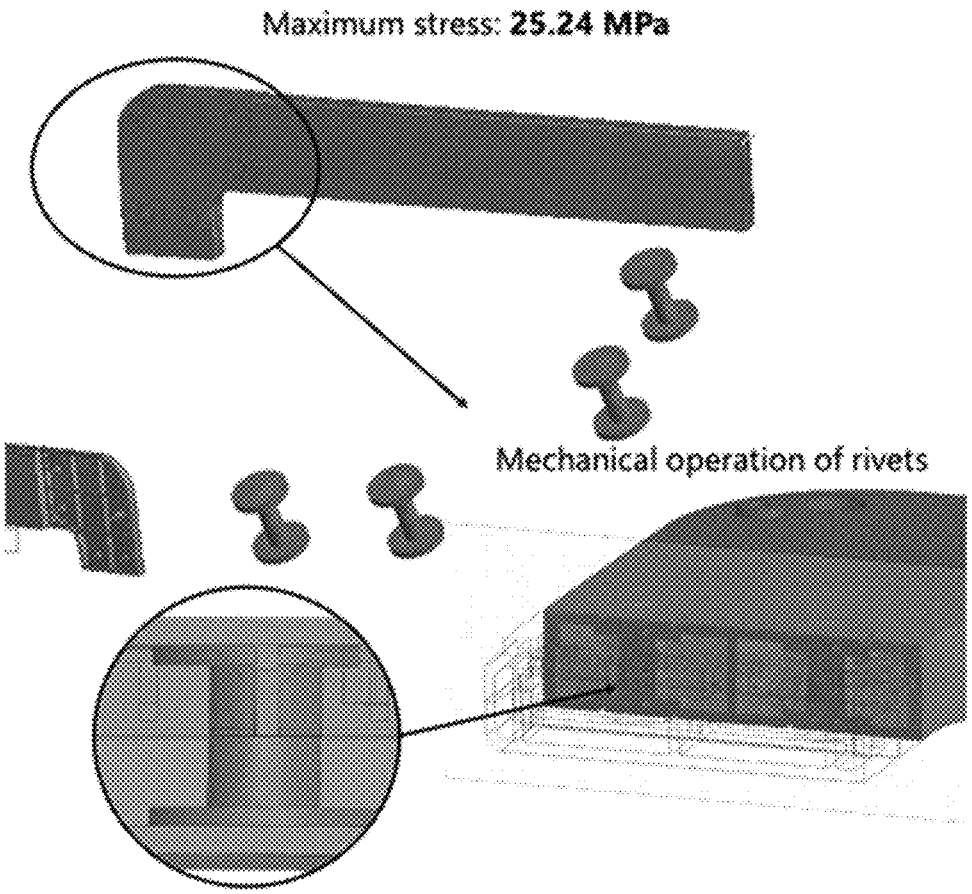
FIG. 14*b* is a graphic representation of a Finite Element Analysis (FEA) applied to the structural system of the present invention, where the maximum stress is shown, once a force has been exerted on it.
Figure 15:
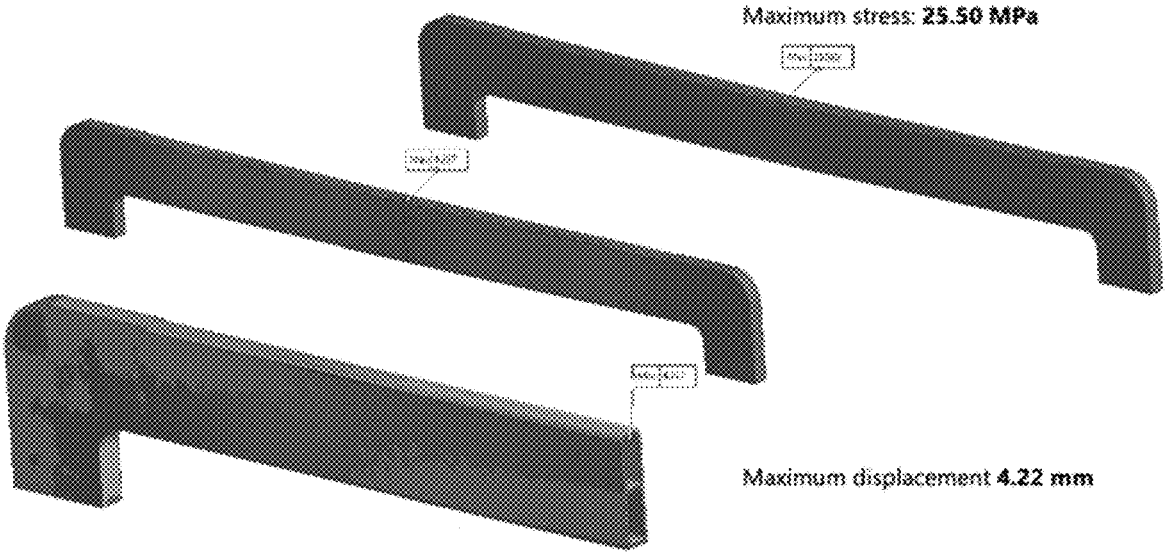
Fig. 15 Prior art
FIG. 15 is a graphical representation of a Finite Element Analysis (FEA) applied to an example of a monolithic frame (prior art) where displacement and maximum stress are shown once a force is exerted on it.

As shown in FIGS. 14*a*, 14*b* and 15, Finite Element Analysis (FEA) tests were carried out, using, firstly, a preferred embodiment of the present invention and, on the other hand, an example of a monolithic top frame.

For the Finite Element Analysis (FEA) test, the following requirements and conditions were considered: Total applied stress for both analyses: 110 lbf.

For the Top Frame according to one embodiment of the present invention:

Use of Upper/Lower fastening means: Rivets, made of Nylon 6/6 Vydyne; Young's modulus: 3000 MPa; Elastic limit: 80 Mpa Stringers (in general): Made of Polypropylene (PP); Young's modulus: 2350 MPa; Elastic limit: 57 MPa.

For the top frame according to the monolithic example (prior art):

Use of hot plate welding technology; the frame is made in a single piece, in Polypropylene (PP); Young's modulus: 2350 MPa; Elastic limit: 57 MPa.

The results of the maximum stress and displacement can be seen in table 1 below:

TABLE 1

| | Maximum stress (MPa) | Maximum displacement (mm) |
|---|---|---|
| According to the present invention: using rivet-type top/bottom fastening means | 25.24 | 5.87 |
| Based on an example of a monolithic top frame (prior art) | 25.50 | 4.22 |

Thus, the top frame described in the present application offers mechanical performance similar to that of an example of a monolithic frame or one formed integrally in a single piece. In other words, the modifications of the frame of the present invention, mainly the design/arrangement in modules (primary and secondary final stringers (20, 20')), advantageously do not compromise the global mechanical interactions of the frame.

Furthermore, in FIGS. 14*a* and 14*b* the assembly and/or separation system (31) according to the embodiment of the present invention shown in the Finite Element Analysis (FEA), offers an outstanding stress distribution, which is the result, first of all, of the arrangement/disposition and interaction resulting from the design of the corner portions of the final stringers as described herein and because of the mechanical interference resulting from the interaction of the assembly and/or separation system when joining the corresponding upper and lower final stringers.

Figure 11:
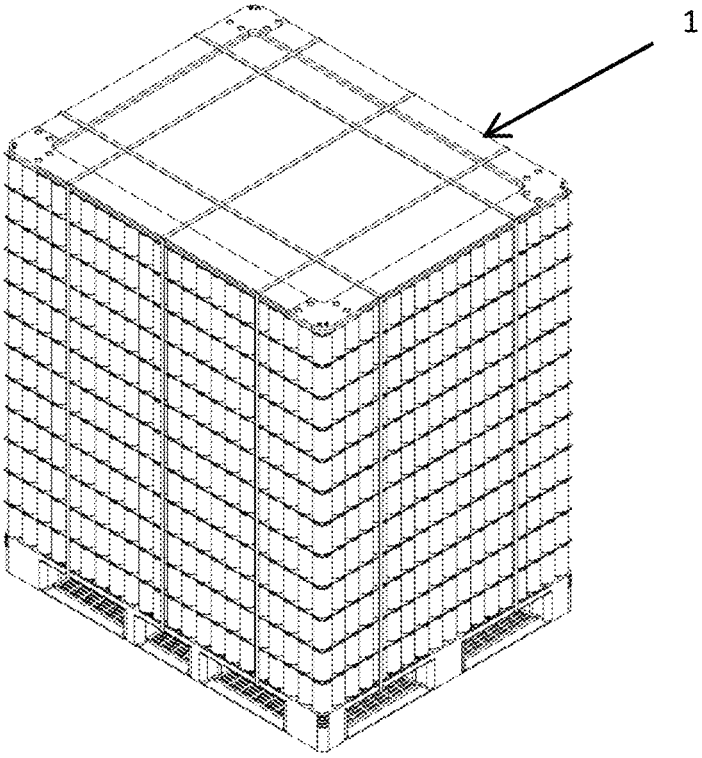
FIG. 11 shows an example of use of the structure system of the present invention, fully incorporated and interacting with product/raw material, a pallet (base) and strips.

In this sense, as previously mentioned in the present application, the assembly and/or separation system allows the corresponding upper and lower final stringer to be joined and the structural system of the present invention to be switched to an operative or functional state, which may be used in a material handling operation, as illustrated in FIG. 11.

Figure 12:
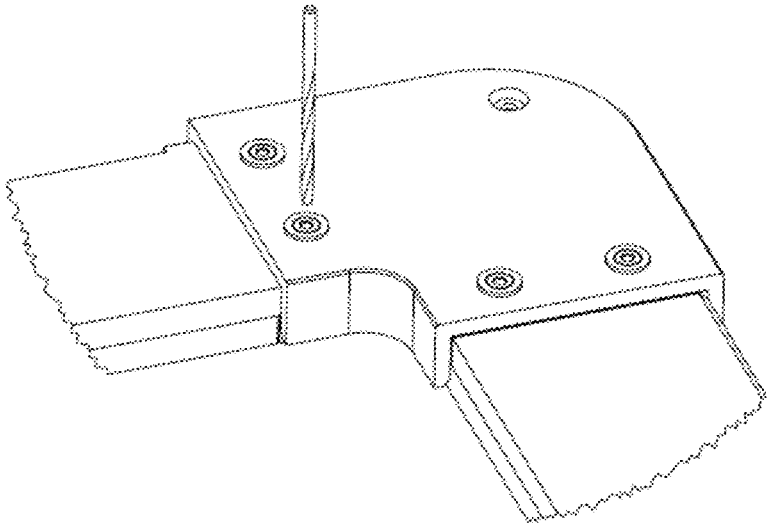
FIG. 12 is a detail view of a corner portion of the structural system of the present invention in an operative/assembled state, where, by means of a roughing tool (drill), a medium will be removed/eliminated. fastening to switch the structural system to a non-operational/disassembled state or for packaging/transport.
Figure 13A:
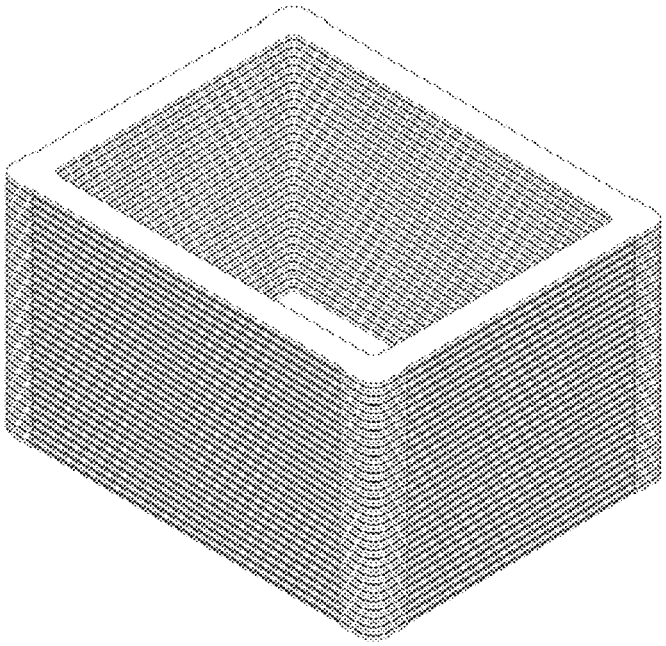
Fig. 13a Prior art
FIG. 13*a* shows an example of arrangement of known frames, wherein said prior art frames are monolithic frames or formed in a single piece.
Figure 13B:
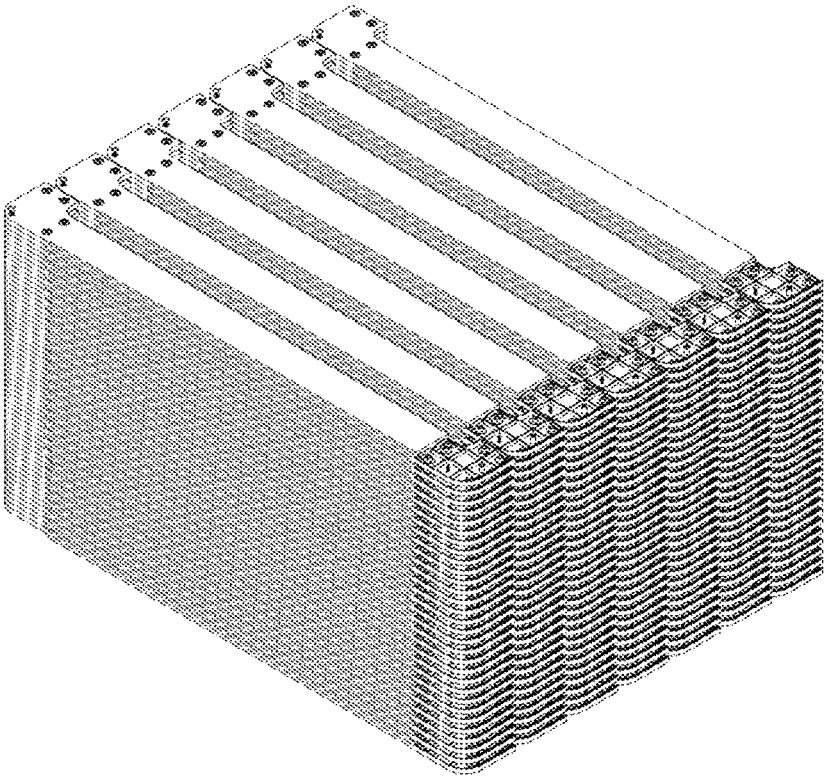
FIG. 13*b* shows an example of arrangement of frames of the structural system of the present invention, in particular, the final beams of the structural system, wherein a more efficient use of the transport/packaging space is observed, advantageously providing greater efficiency in the transportation logistics.

Advantageously, the assembly and/or separation system can be removed from the structural system of the present invention, by means of and not limited to, the use of a roughing tool, such as a drill (see FIG. 12). The purpose of removing/eliminating the assembly system and/or separation of the final stringers is to switch the structural system to a state of packaging, non-operational, disassembled and/or transport, managing to separate each of the pieces to be able to be transported in a more efficient way, providing a clear advantage over the stacking mode, as seen in FIG. 13*b*, compared to the use of space that is required for the transport of monolithic top frames (prior art), as seen in FIG. 13*a*.

Based on the above, the structural system of the present invention, according to any of its previously described embodiments, offers an efficient and practical solution for a top frame for material handling operations, offering outstanding mechanical performance and clearly comparable with a monolithic frame, as well as a greater advantage for the use of space during the packaging and transportation of the structural system, which will directly increase the efficiency of logistics when using the present invention in contrast to the currently known superior frames.

Next, the list of elements with their respective identifier will be provided.

1 frame
10 primary top stringer portion
10' secondary top stringer portion
11 primary bottom stringer portion
11' secondary bottom stringer portion
20 final main stringer
20' final secondary stringer
30 holding medium receiver
31 assembly and/or separation system
32 receiver anti-skid element
31*a* upper holding medium
31*b* lower holding medium
40*th* primary corner rib arrangement
40*b* primary straight zone rib arrangement
40*c* upper reinforcement interface
40*d* Flange
41*a* secondary corner rib arrangement
41*b* secondary straight zone rib arrangement
41*c* lower reinforcement interface

The invention claimed is:

1. A top frame structural system comprising:
primary and secondary final stringers, each of the primary and secondary final stringers comprising:
a corner portion; and
a separation system;
wherein a corner portion of a primary final stringer is configured to receive a corner portion of at least one of the secondary final stringers, in such a way that a splice of a corner area of the primary final stringer covers the entire corner area of the secondary final stringer; and
wherein the separation system in turn comprises upper and lower fasteners and corresponding holes for each of the fasteners, and once the primary and secondary final stringers are joined, the fasteners are configured to ensure a correct hyperstatic coupling between the primary and secondary final stringers.

2. The top frame structural system according to claim 1, wherein the primary and secondary final stringers are each made from a union of an upper portion and a lower portion, joined by a permanent coupling treatment.

3. The top frame structural system according to claim 2, wherein the upper portion and the lower portion each comprise at least one and up to "n" number of flanges, in the respective end portions, which are configured to engage or couple with each other, in a crimping manner, when the upper and lower portion cooperate to form the primary and secondary end stringers.

4. The top frame structural system according to claim 3, wherein the flanges are at least two and up to "n" number of flanges separated at a distance ranging from 1 mm to 25 mm or can be a single flange that extends from one lateral end to the other lateral end of the respective upper and lower stringer.

5. The top frame structure system according to claim 2, wherein the permanent coupling treatment is a process of ultrasonic welding, linear and orbital type vibration welding, hot plate welding and/or combinations thereof, permanently joining the respective upper and lower portions to form a respective final stringer.

6. The top frame structural system according to claim 2, wherein the upper portions, the lower portions or the primary and secondary final stringers, are configured for manufacturing by any selected from the group comprising injection and/or extrusion, blowing, vacuum, spin casting, polymer casting, three-dimensional printing, gas-assisted injection, or a combination thereof.

7. The top frame structural system according to claim 1, wherein the separation system comprises at least two and up to "n" number of holes distributed uniformly and/or in an arrangement in the corner area of each of the final stringers.

8. The top frame structural system according to claim 7, wherein the holes of the separation system are holes with a diameter ranging from ⅛ inch and up to 1 inch having a machining or machined-like finish such as a countersink, chamfer, flare and/or combinations thereof.

9. The top frame structural system according to claim 1, wherein the upper and lower fasteners are any selected from the group comprising: ratchet-type rivets, hot rivets, screws, pins, or combinations of the same.

10. The top frame structural system according to claim 9, wherein the upper and lower fasteners are placed within the holes, wherein the upper fasteners are in an opposite orientation with respect to the lower fasteners.

11. The top frame structural system according to claim 9, wherein the upper and lower fasteners are configured to be removed and/or eliminated by destroying the integrity of the upper and lower fasteners but without damaging the corner areas of the primary and secondary final stingers.

12. The top frame structural system according to claim 1, wherein each of the primary and secondary final stringers has a straight area and a corner area, forming an "L" shape, and wherein the corner area protrudes or projects with respect to the level of the straight area.

13. The top frame structural system according to claim 1, wherein the upper and lower portions have lengths ranging from 5 inches to 70 inches, with widths ranging from 3 inches to 15 inches and thicknesses and/or height ranging from ½ inch to 5 inches.

14. The top frame structural system according to claim 1, wherein the primary and secondary final stringers have lengths ranging from 5 inches to 70 inches, with widths ranging from 3 inches and up to 15 inches and a height ranging from 1 inch to 10 inches.

15. The top frame structural system according to claim 1, wherein the upper portions, the lower portions or the primary and secondary final stringers directly manufactured are manufactured of a material selected from the group comprising: polyethylene (PER or PETE), high-density polyethylene (HDPE), low-density polyethylene (LDPE), polypropylene (PP), polystyrene (PS), ASA, ABS, as well as reinforced plastic materials thermoplastics, or combinations thereof.

16. The top frame structural system according to claim 1, wherein the separation system can be removed/detached from each corner area of each primary and secondary final stringer and the top frame structural system can be switched to a state of disassembled, allowing replacement of primary or secondary final stringers that have suffered structural damage and/or to be able to be transported efficiently.

17. The top frame structural system according to claim 1, wherein the primary or secondary final stringers also comprise at least one and up to "n" number of anti-skid element receiving holes, which are configured to receive inside, hold and/or fix an anti-skid element each.

18. The top frame structural system according to claim 1, wherein at least one of the primary or secondary final stringers further comprise, in their lower or inner portions, an arrangement of ribs.

19. The top frame structural system according to claim 18, wherein the arrangement of ribs is divided into two zones, one corresponding to the corner and the other corresponding to the straight zone.

20. The top frame structural system according to claim 1, wherein at least one of the primary or secondary final stringers do not comprise any arrangement of ribs inside, being substantially hollow or smooth.

21. The top frame structural system according to claim 1, wherein the primary and secondary final stringers further comprise, in their lower or inner portions, a section and/or reinforcement interface having an area with a more concentrated geometry and/or shape of walls.

22. The top frame structural system according to claim 1, wherein the primary and secondary final stringers further comprise, in their upper or outer portions, a smooth surface.

23. The top frame structural system according to claim 1, wherein the primary and secondary final stringers each comprise the same length, width and geometry.

* * * * *